US007513014B2

(12) United States Patent
Lin

(10) Patent No.: US 7,513,014 B2
(45) Date of Patent: Apr. 7, 2009

(54) HINGE ASSEMBLY

(75) Inventor: Tzu-Yu Lin, Shulin (TW)

(73) Assignee: Shin Zu Shing Co., Ltd., Taipei Hsien (TW)

( * ) Notice: Subject to any disclaimer, the term of this patent is extended or adjusted under 35 U.S.C. 154(b) by 0 days.

(21) Appl. No.: 11/892,335

(22) Filed: Aug. 22, 2007

(65) Prior Publication Data

US 2009/0049649 A1 Feb. 26, 2009

(51) Int. Cl.
*E05D 11/06* (2006.01)

(52) U.S. Cl. ..... 16/374; 16/342; 16/348; 361/681; 248/922

(58) Field of Classification Search ..... 16/374, 16/363, 342–343, 319, 348, 357; 248/922; 361/681; 403/116
See application file for complete search history.

(56) References Cited

U.S. PATENT DOCUMENTS 6,321,416 B1 * 11/2001 Lu ..... 16/374
6,513,197 B2 * 2/2003 Rude et al. ..... 16/342
6,671,929 B1 * 1/2004 Lu ..... 16/342
6,748,625 B2 * 6/2004 Lu ..... 16/285
6,820,307 B2 * 11/2004 Lu ..... 16/342
6,868,582 B2 * 3/2005 Lu et al. ..... 16/342

* cited by examiner

*Primary Examiner*—William L. Miller
(74) *Attorney, Agent, or Firm*—Bacon & Thomas, PLLC

(57) ABSTRACT

A hinge assembly is mounted in an electronic appliance such as a notebook and has a stationary leaf, a pintle and a pivoting leaf. The notebook has a base and a cover. The stationary leaf is mounted securely on the base and has a pivoting sleeve having an outer edge, a limiting tab and at least one braking detent. The limiting tab and braking detent adjacently protrude longitudinally from the outer edge of the pivoting sleeve. The pintle is mounted rotatably in the stationary leaf and has an outer end and a limiting rod. The limiting rod is mounted securely in the pintle and selectively limits rotation of the hinge in both directions to leave a small gap when the cover folds toward the base to facilitate opening. The pivoting leaf is mounted securely on the outer end of the pintle and connects to the cover securely.

14 Claims, 11 Drawing Sheets

HINGE ASSEMBLY

BACKGROUND OF THE INVENTION

1. Field of the Invention

The present invention relates to a hinge assembly, and more particularly to a hinge assembly to attach a cover pivotally to a base of an electronic appliance.

2. Description of the Prior Arts

An electronic appliance such as a notebook comprises a base, a cover, a conventional hinge and a lock assembly. The base has a front edge and a rear. The cover corresponds to and is mounted pivotally on the base and has a front edge and a rear. The conventional hinge is mounted between the rear of the base and the rear of the cover to allow the cover to rotate relative to the base, so the cover is able to selectively fold open and closed relative to the base and creates a frictional force to hold the cover at desired angles. The lock assembly is mounted between the front edge of the cover and the front edge of the base to prevent the cover moving relative to the base when the notebook is closed.

However, when a user unlocks the lock assembly of the notebook and attempts to open the cover, the cover is not easily opened because of the frictional force of the hinge. Therefore, the base must be held down whilst the cover is opened. Since there is no gap between the cover and the base, this operation is awkward and inconvenient.

To overcome the shortcomings, the present invention provides a hinge assembly to mitigate or obviate the aforementioned problems.

SUMMARY OF THE INVENTION

The primary objective of the present invention is to provide a hinge assembly to make the electronic appliance easily open.

The hinge assembly is mounted in an electronic appliance such as a notebook and has a stationary leaf, a pintle and a pivoting leaf. The notebook has a base and a cover. The stationary leaf is mounted securely on the base and has a pivoting sleeve having an outer edge, a limiting tab and at least one braking detent. The limiting tab and braking detent adjacently protrude longitudinally from the outer edge of pivoting sleeve. The pintle is mounted rotatably in the stationary leaf and has an outer end and a limiting rod. The limiting rod is mounted securely in the pintle and selectively limits rotation of the hinge in both directions to leave a small gap when the cover folds toward the base facilitate opening. The pivoting leaf is mounted securely on the outer end of the pintle and connects to the cover securely.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
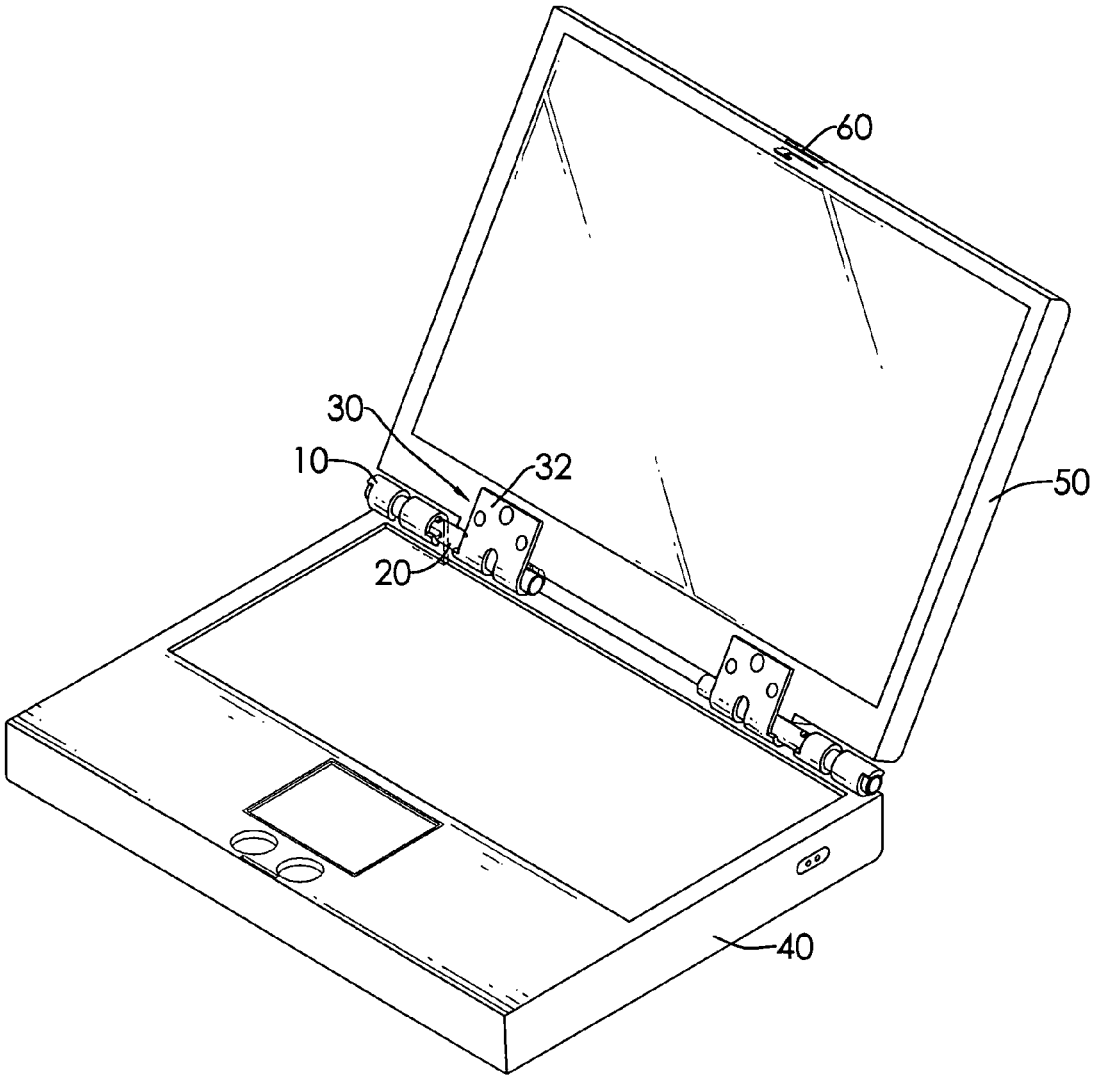
FIG. 1 is a perspective view of a hinge assembly in accordance with the present invention mounted in a notebook.
Figure 2:
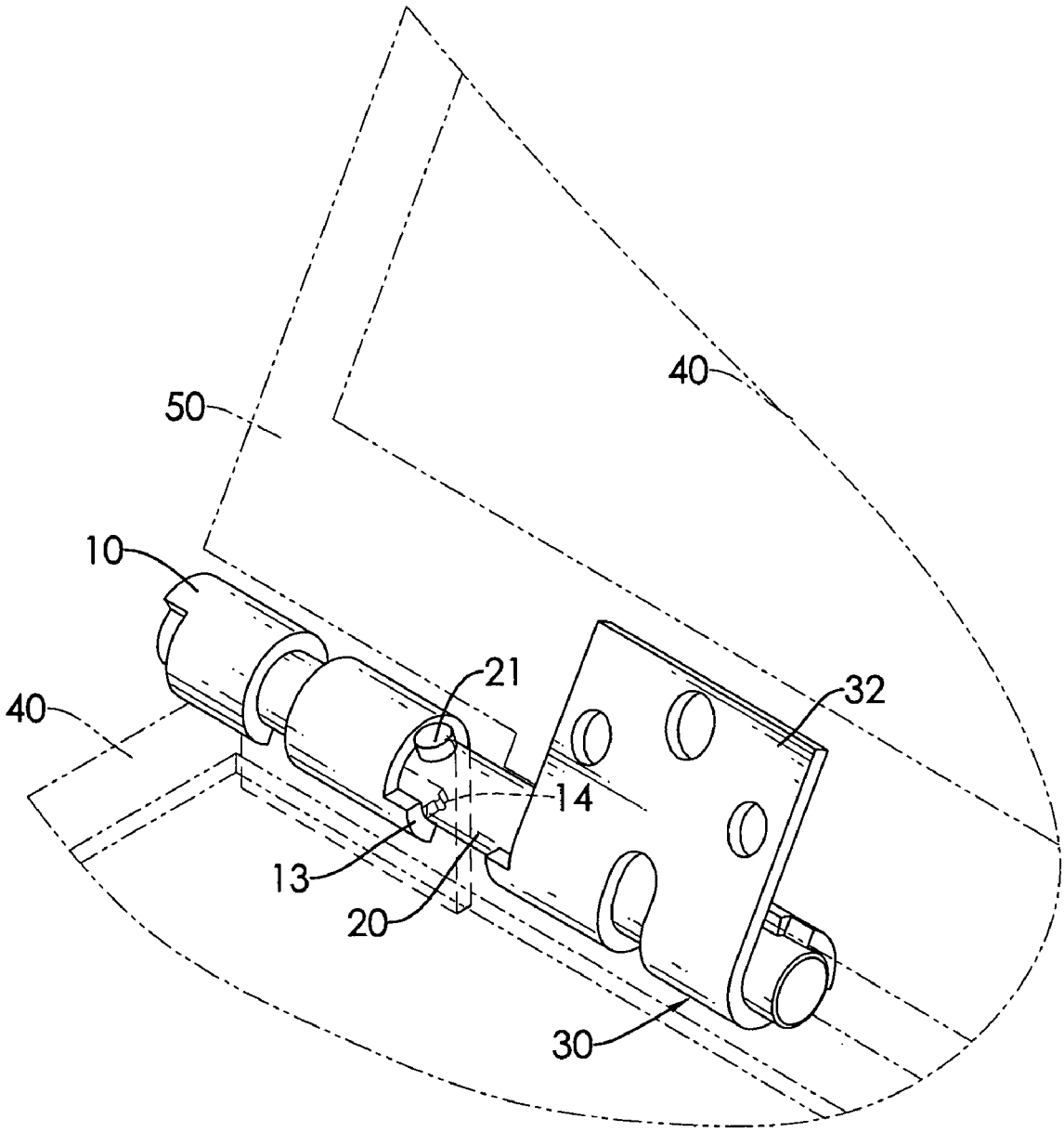
FIG. 2 is an enlarged perspective view of the hinge assembly in FIG. 1 mounted in a notebook.

With reference to FIGS. 1, 2, 9 and 11, a hinge assembly in accordance with the present invention is mounted in an electronic appliance such as a notebook and comprises a stationary leaf (10, 10A, 10B), a pintle (20) and a pivoting leaf (30).

The notebook comprises a base (40), a cover (50) and an external lock (60). The base (40) has a front edge and a rear. The cover (50) is connected pivotally with the rear of the base (40) and has a front edge and a rear. The external lock (60) is mounted between the front edge of the cover (50) and the front edge of the base (40) to lock the cover (50) on the base (40) when the cover (50) is closed.

Figure 3:
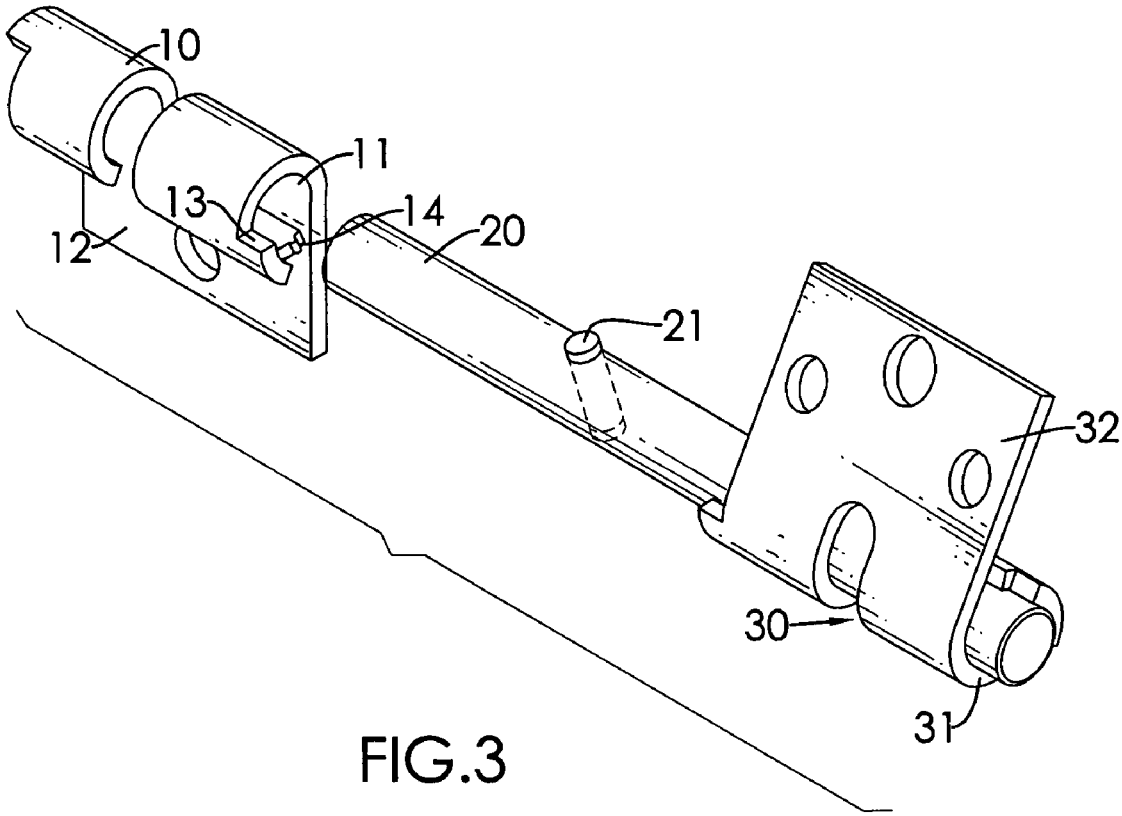
FIG. 3 is a perspective view of the hinge assembly in FIG. 1.
Figure 5:
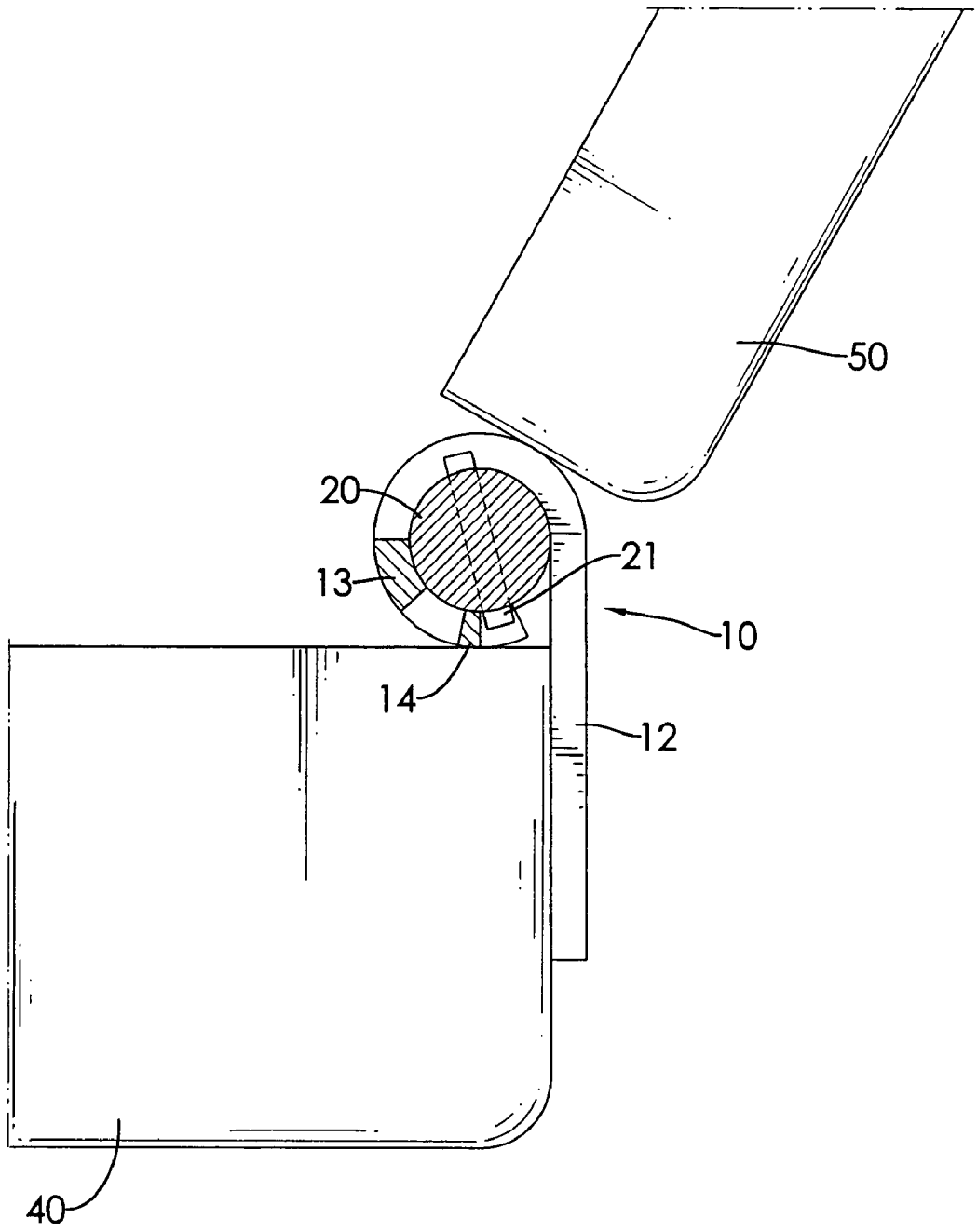
FIG. 5 is an operational side view in partial section of the hinge assembly in FIG. 1 mounted in a notebook, shown open.

With further reference to FIGS. 3 and 5, the stationary leaf (10, 10A, 10B) is mounted securely on the rear of the base (40) and has a stationary sleeve and a mounting segment (12).

The stationary sleeve has an inner end, an outer end, an outside surface, a gudgeon (11), a slit, an optional limiting channel (15A, 15B), a limiting tab (13, 13A, 13B) and at least one braking detent (14, 14A, 14B).

The gudgeon (11) is a cylindrical hole and is formed coaxially through the stationary sleeve of the stationary leaf (10, 10A, 10B).

The slit is formed longitudinally through the outside surface of the stationary sleeve of the stationary leaf (10) from end to end and communicates with the gudgeon (11) to allow the gudgeon (11) to expand.

The limiting channel (15A, 15B) is formed transversely through the stationary leaf (10A, 10B) and has an outer edge and may have an inner edge. The outer edge of the limiting channel (15A, 15B) faces a center of the notebook. The inner edge of the limiting channel (15A, 15B) faces away from the center of the notebook.

The limiting tab (13, 13A, 13B) has two sides, is formed on and protrudes longitudinally from the stationary sleeve and may protrude longitudinally from the outer end of the stationary sleeve or may protrude longitudinally from the outer edge of the limiting channel (15A, 15B).

Figure 10:
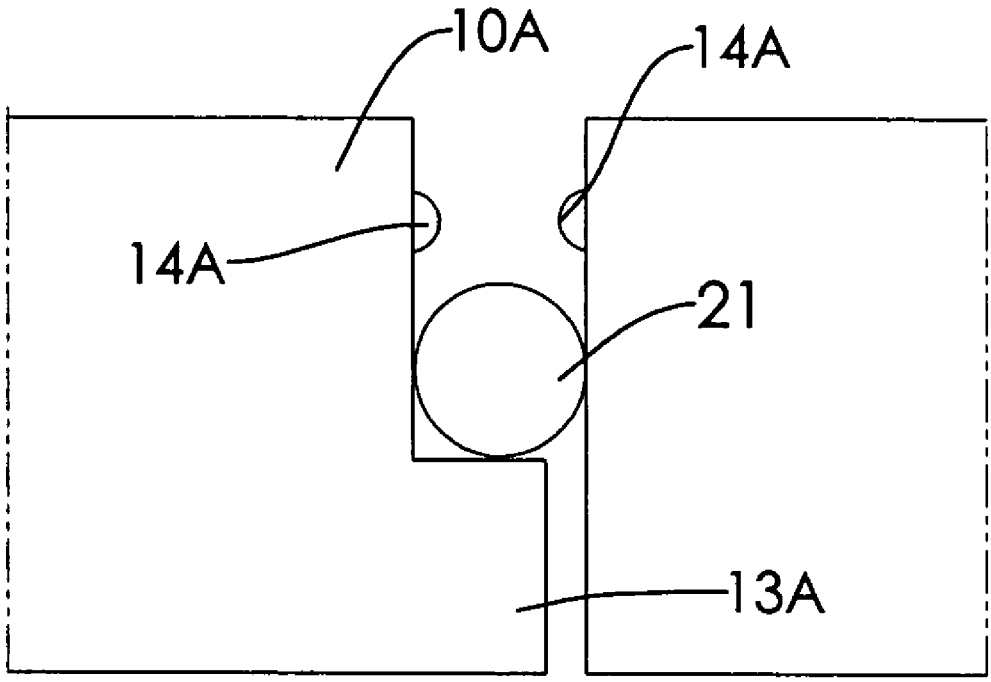
FIG. 10 is an operational cross-section top view of the hinge assembly in FIG. 9, showing the limiting rod abutting the limiting tab.
Figure 11:
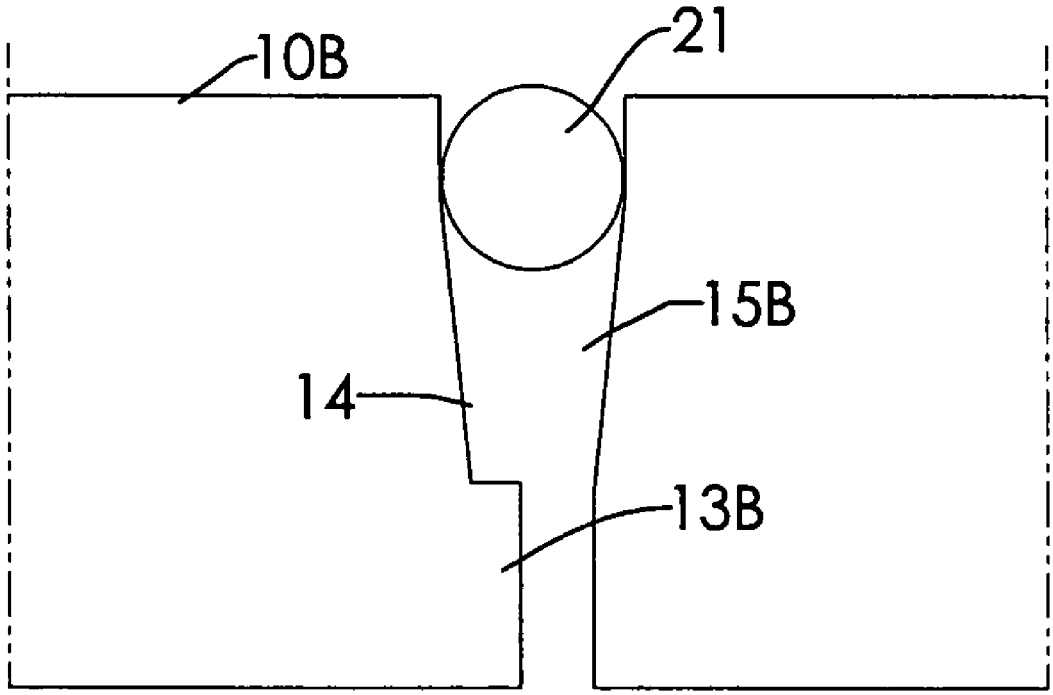
FIG. 11 is operational cross-section top view of a third embodiment of the hinge assembly in accordance with the present invention, showing the limiting rod abutting the braking detent.

With further reference to FIG. 10, the at least one braking detent (14, 14A, 14B) is formed on and protrudes from the stationary sleeve near the limiting tab (13, 13A, 13B), may be convex, may be smaller than the limiting tab (13, 13A) and prevents the cover (50) from being snapped open and damaging the hinge. The at least one braking detent (14, 14A, 14B) may protrude from the outer end of the stationary sleeve or may protrude from the outer edge of the limiting channel (15A) or may be tapering of the limiting channel toward the limiting tab (13B). When the stationary leaf (10A, 10B) has two braking detents (14A, 14B), a second braking detent (14A, 14B) is formed on and protrudes from the inner edge of the limiting channel (15A, 15B). The mounting segment (12) is formed on and extends from the outside surface of the stationary sleeve and attaches securely to the rear of the base (40).

The pintle (20) is cylindrical, is tightly mounted rotatably in the gudgeon (11) and extends out of the stationary leaf (10, 10A, 10B) and has an inner end, an outer end, a limit mount and a limiting rod (21).

The inner end of the pintle (20) is tightly mounted rotatably in the gudgeon (11) of the stationary leaf (10).

The limit mount is formed transversely through the pintle (20) corresponding to the limiting tab (13, 13A, 13B) and the braking detent (14, 14A, 14B).

Figure 4:
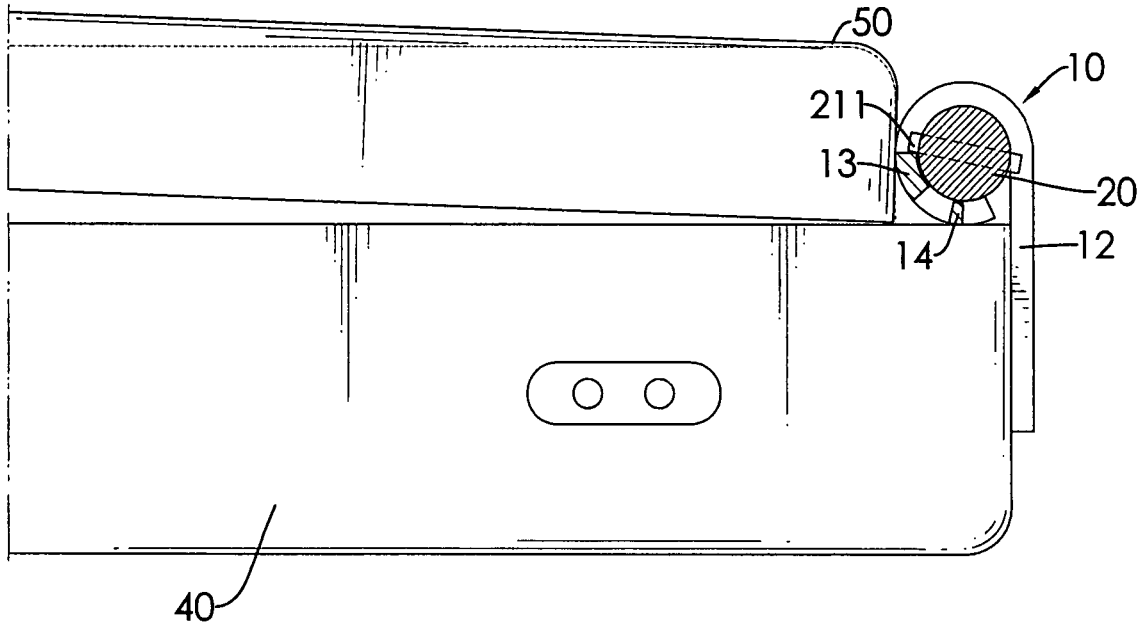
FIG. 4 is an operational side view in partial section of the hinge assembly in FIG. 1 mounted in a notebook, shown closed.
Figure 7A:
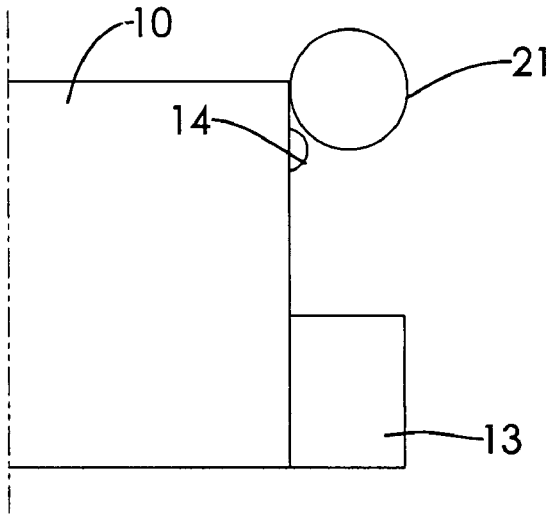
FIGS. 7A and 7B is operational enlarged cross-section top views of the hinge assembly in FIG. 1 showing a limiting rod sliding through a braking detent to abut the limiting tab.
Figure 7B:
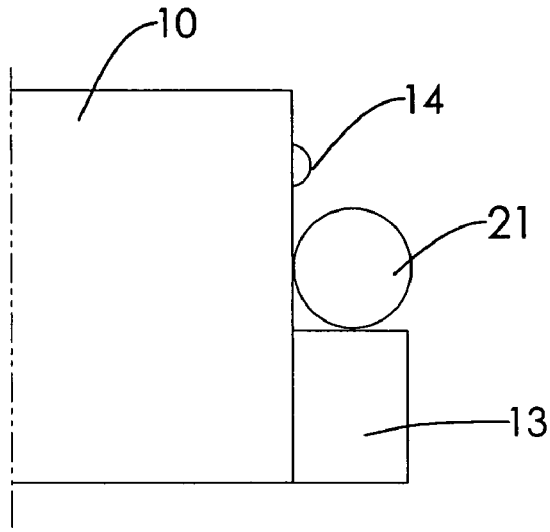
Figure 8:
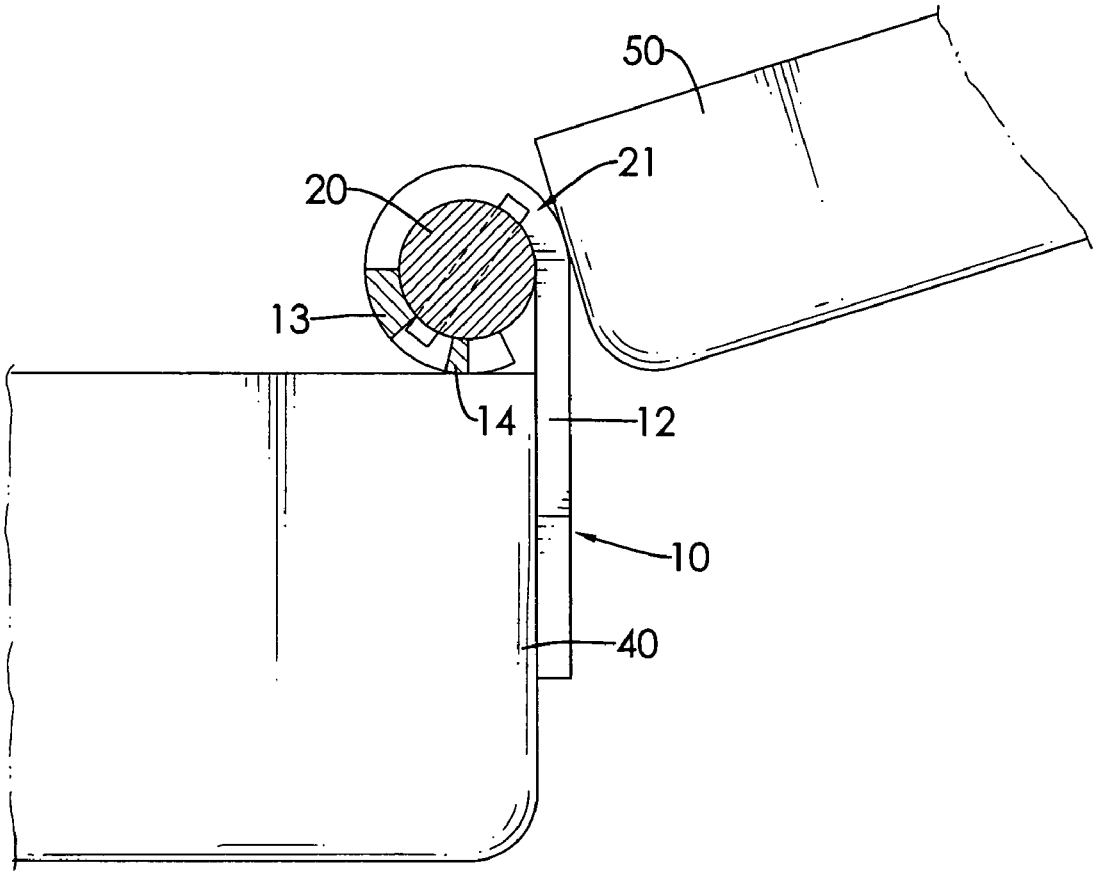
FIG. 8 is an operational side view in partial section of the hinge assembly in FIG. 1 mounted in a notebook, shown at maximum opening.
Figure 9:
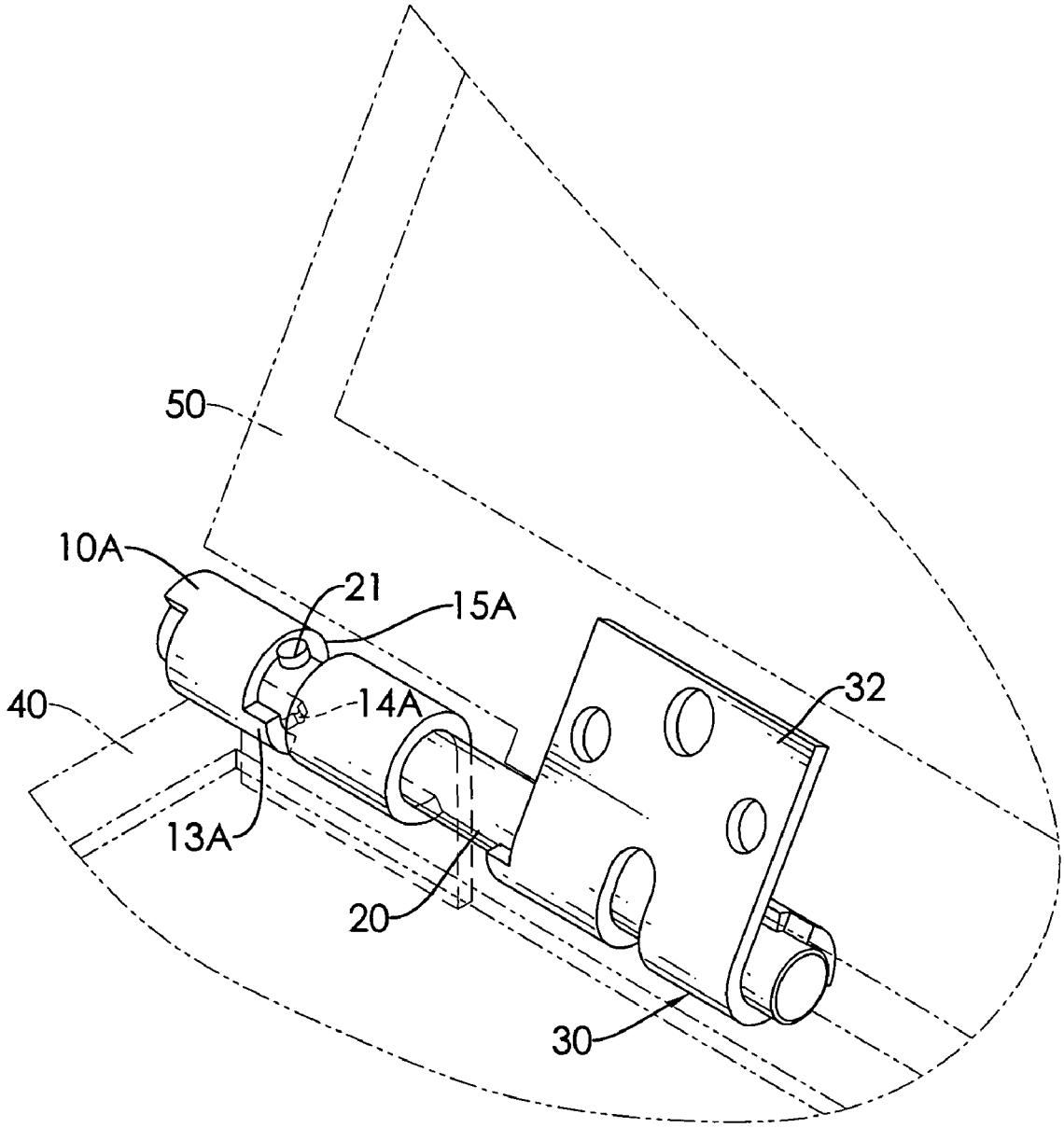
FIG. 9 is an enlarged perspective view of another embodiment of the hinge assembly in accordance with the present invention mounted in a notebook.

With further reference to FIGS. 4, 7 and 8, the limiting rod (21) is mounted securely in the limit mount of the pintle (20) and has two ends. The ends of the mounting rod (21) diametrically extends transversely out of the pintle (20), each selectively abut respectively the sides of the limiting tab (13, 13A, 13B) to limit rotation of the hinge in both directions and to leave a small gap between the cover (50) and the base (40) when the cover (50) is folded toward the base. One end of the limiting rod (21) selectively abuts each braking detent (14, 14A, 14B) to prevent fast over-rotation of the hinge damaging the limiting rod (21) or the limiting tab (13, 13A, 13B) when the cover (50) is opened. The pivoting leaf (30) is mounted securely on the outer end of the pintle (20), connects to the cover (50) to allow the cover (50) to pivot relative to the base (40) and may has a pivoting sleeve (31) and a mounting segment (32).

The pivoting sleeve (31) is mounted securely on the outer end of the pintle (20) and has an outside surface, a mounting hole and a slit.

The mounting hole is formed coaxially through the pivoting sleeve (31) of the pivoting leaf (30) and is mounted securely around the outer end of the pintle (20).

The slit is formed longitudinally through the outside surface of the pivoting sleeve (31) of the pivoting leaf (30) from end to end and communicates with the mounting hole.

The mounting segment (32) is formed on and extends from the outside surface of the pivoting sleeve (31) and attaches securely to the rear of the cover (50).

Figure 6:
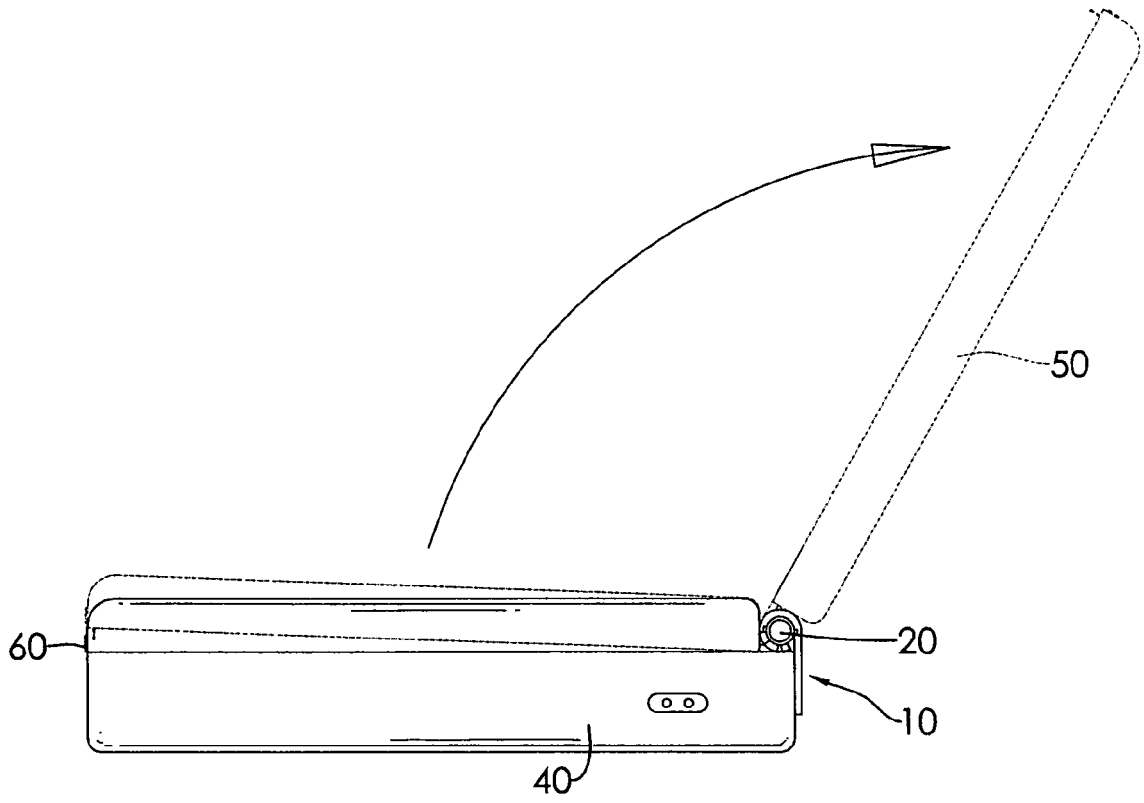
FIG. 6 is an operational side view of the hinge assembly in FIG. 1 mounted in a notebook showing the cover is opened.

With further reference to FIG. 6, when the external lock (60) of the notebook is unlocked, the hinge allows the cover (50) to spring up automatically and form the gap between the cover (50) and base (40) to allow a user to easily open the cover by inserting his fingers into the gap.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hinge assembly comprising:

a tubular stationary leaf, a cylindrical pintle, and a pivoting leaf, wherein the tubular stationary leaf has a stationary sleeve and a mounting segment, and the stationary sleeve comprises:

an inner end;

an outer end;

an outside surface;

a gudgeon formed coaxially through the stationary sleeve as cylindrical hole;

a slit formed longitudinally through the outside surface of the stationary sleeve from end to end and communicating with the gudgeon;

a limiting tab having two sides and being formed on and protruding longitudinally from the stationary sleeve; and at least one braking detent formed on and protruding from the stationary sleeve near the limiting tab, wherein the mounting segment is formed on and extends from the outside surface of the stationary sleeve, wherein the pintle is tightly mounted rotatably in the gudgeon extending out of the stationary leaf and comprises:

an inner end tightly mounted rotatably in the gudgeon of the sleeve of the stationary leaf;

an outer end;

a limit mount formed transversely through the pintle and corresponding to the limiting tab and the braking detent; and a limiting rod mounted securely in the limit mount of the pintle and having two ends diametrically extending transversely out of the pintle, each end of the limiting rod selectively abutting respectively the sides of the limiting tab, and one end of the limiting rod selectively abutting the braking detent, wherein the pivoting leaf is mounted securely on the outer end of the pintle and comprises:

a pivot sleeve mounted securely on the outer end of the pintle and having an outside surface; and a pivoting leaf mounting segment formed on and extending from the outside surface of the pivoting leaf.

2. The hinge assembly as claimed in claim 1, wherein the limiting tab protrudes longitudinally from the outer end of the stationary sleeve;

the at least one braking detent is convex, smaller than the limiting tab and protrudes from the outer end of the stationary sleeve.

3. The hinge assembly as claimed in claim 2, wherein the pivoting sleeve has a mounting hole being formed coaxially through the pivoting sleeve of the pivoting leaf and being mounted securely around the outer end of the pintle; and a slit being formed longitudinally through the outside surface of the pivoting sleeve of the pivoting leaf from end to end and communicating with the mounting hole of the pivoting leaf.

4. The hinge assembly as claimed in claim 1, wherein the stationary leaf further has a limiting channel being formed transversely through the stationary leaf and the limiting channel further has an inner edge; and the limiting tab protrudes longitudinally from the outer edge of the limiting channel; and the at least one braking detent protrudes from the outer edge of the limiting channel.

5. The hinge assembly as claimed in claim 4, wherein the at least one braking detent is convex and is smaller than the limiting tab.

6. The hinge assembly as claimed in claim 5, wherein the pivoting sleeve has a mounting hole being formed coaxially through the pivoting sleeve of the pivoting leaf and being mounted securely around the outer end of the pintle; and a slit being formed longitudinally through the outside surface of the pivoting sleeve of the pivoting leaf from end to end and communicating with the mounting hole of the pivoting leaf.

7. The hinge assembly as claimed in claim 4, wherein the at least one braking detent is inclined toward the limiting tab.

8. The hinge assembly as claimed in claim 7, wherein the pivoting sleeve has a mounting hole being formed coaxially through the pivoting sleeve of the pivoting leaf and being mounted securely around the outer end of the pintle; and a slit being formed longitudinally through the outside surface of the pivoting sleeve of the pivoting leaf from end to end and communicating with the mounting hole of the pivoting leaf.

9. The hinge assembly as claimed in claim 1, wherein the stationary leaf further has a limiting channel being formed transversely through the stationary leaf and the limiting channel further has an inner edge; and the limiting tab protrudes longitudinally from the outer edge of the limiting channel; and the stationary leaf has two braking detents protruding respectively from the outer edge and the inner edge of the limiting channel.

10. The hinge assembly as claimed in claim 9, wherein the braking detents are convex and are smaller than the limiting tab.

11. The hinge assembly as claimed in claim 10, wherein the pivoting sleeve has a mounting hole being formed coaxially through the pivoting sleeve of the pivoting leaf and being mounted securely around the outer end of the pintle; and a slit being formed longitudinally through the outside surface of the pivoting sleeve of the pivoting leaf from end to end and communicating with the mounting hole of the pivoting leaf.

12. The hinge assembly as claimed in claim 9, wherein the braking detents are inclined toward the limiting tab.

13. The hinge assembly as claimed in claim 12, wherein the pivoting sleeve has a mounting hole being formed coaxially through the pivoting sleeve of the pivoting leaf and being mounted securely around the outer end of the pintle; and a slit being formed longitudinally through the outside surface of the pivoting sleeve of the pivoting leaf from end to end and communicating with the mounting hole of the pivoting leaf.

14. An electronic device having the hinge assembly as claimed in claim 1 and comprising:

a base;

a cover mounted rotatably on the base, wherein the mounting segment of the stationary leaf is mounted on the base, the mounting segment of the pivoting leaf is mounted on the cover, the limiting rod of the pintle abuts the limiting tab of the stationary leaf and stops the cover from being completely closed against the base.

* * * * *